United States Patent [19]

Ross

[11] 4,102,410

[45] Jul. 25, 1978

[54] RESILIENT WORK-COUPLED IMPACT DEVICE

[76] Inventor: Frederick W. Ross, 755 Klamath Dr., Del Mar, Calif. 92014

[21] Appl. No.: 559,667

[22] Filed: Mar. 19, 1975

[51] Int. Cl.[2] ..... B25D 17/08

[52] U.S. Cl. ..... 173/133; 173/118; 173/139; 173/162

[58] Field of Search ..... 173/162, 118, 116, 139, 173/133, 14–17

[56] References Cited

U.S. PATENT DOCUMENTS

| | | | |
|---|---|---|---|
| 1,399,387 | 12/1921 | Jackson | 173/139 X |
| 1,708,975 | 4/1929 | Skaer et al. | 173/139 X |
| 1,800,465 | 4/1931 | Miller et al. | 173/14 |
| 1,827,877 | 10/1931 | Meeker et al. | 173/14 |
| 1,896,992 | 2/1933 | Agren | 173/139 X |
| 1,969,153 | 8/1934 | Roberts | 173/139 X |
| 2,372,019 | 3/1945 | Stair | 173/133 |
| 2,597,292 | 5/1952 | Coates | 173/119 X |
| 2,949,909 | 8/1960 | Macchioni et al. | 173/139 X |
| 3,266,581 | 8/1966 | Cooley et al. | 173/139 X |
| 3,559,753 | 2/1971 | Meri | 173/139 X |
| 3,625,295 | 12/1971 | Gunning | 173/15 |
| 3,739,862 | 6/1973 | Gunning | 173/16 |
| 3,837,409 | 9/1974 | Consoli et al. | 173/118 X |

FOREIGN PATENT DOCUMENTS

| | | | |
|---|---|---|---|
| 2,207,961 | 8/1973 | Fed. Rep. of Germany | 173/139 |

*Primary Examiner*—Ernest R. Purser
*Assistant Examiner*—William F. Pate, III

[57] ABSTRACT

An impact device, incorporating power drive means having a resilient drive element for generating successive ram impacts against a tool by reaction of the resilient drive element against the device frame, incorporates resilient bias means, interposed between the frame and the tool, to continuously transmit bias force from frame to tool acting to hold the tool firmly against a workpiece during operation, while resiliently suspending the frame for free dynamic motion clear of motion limiting stops, thereby eliminating spurious tool and frame motions and directing the impact energy of the ram to more efficiently and effectively accomplish impact work.

32 Claims, 7 Drawing Figures

RESILIENT WORK-COUPLED IMPACT DEVICE

BACKGROUND OF THE INVENTION

Impact devices are used for breaking or drilling concrete, tamping soils, riveting, and other such difficult tasks. For many years such devices have been powered by compressed air. More recently hydraulic powdered devices, and devices utilizing electrical power driving a cylinder-piston air spring, a coil spring, or other resilient drive element have been devised which have comparable capability.

Although such prior art devices develop high impacting capability in the ram, they fail to transmit and apply such high ram impacting capability through the tool to the work to effectively and efficiently accomplish the work intended.

All such prior art devices incorporate power drive means to drive a ram into reciprocating impacting motion by action through a resilient drive element supported directly or indirectly against the frame. Accordingly such power drive means also actuate the frame into opposite reactive motion. Such reactive motion is the principal cause of the deficiencies of such prior art devices, in applying such high performance impacting of the ram to accomplish the work inteneded.

Other, less effective, prior art means for actuating a ram into impacting motion include rotatiing eccentric weights pivoted directly on the ram. Such devices (1) are limited to impacting accelerations low enough to maintain force loadings on the pivots and rotary drive means within practical bounds, (2) require heavy rotating weights, not necessary with other prior art devices, and (3) have problems of phasing the rotations of the weights with the ram reciprocations to obtain reasonable impacting effectiveness. U.S. Pat. No. 2,176,801 (Oct. 17, 1939) discloses an embodiment incorporating such rotating weights with an air spring and two coil springs to provide such phasing. Another prior art means for actuating the ram, as disclosed in U.S. Pat. No. 973,216 (Oct. 18, 1910), incorporates a magnetic coupling means, which is heavy, ineffective, and requires an auxiliary electric power source. Because of such deficiencies, impact devices incorporating rotating eccentrics or magnetic means have had no known practical acceptance.

In all such devices each impact is generated by the sudden stopping of a moving ram. At least two elements are involved in such action; a ram and a tool. These elements may be (1) secured together, as the head and point of a pickax, which are thrust, as a unit, toward a workpiece, as disclosed in U.S. Pat. No. 2,420,793 (May 20, 1947); or, (2) the tool may be held separately against the workpiece to receive impact of the ram and transmit the resulting force sharply to the workpiece, as in a hammer-chisel action. For most applications, especially for working harder surfaces, years of experience in the prior art have shown the hammer-chiesel action to be much more effective than pickax action.

Typically, for high performance piror art impact devices, the ram impacts a tool positioned by a tool holder on the frame to accept such impacting, which is transmitted from ram to tool to accomplish the work, ideally by hammer-chisel action as described hereinbefore. In all known prior art devices, however, an ideal hammer-chisel action is not attained.

The output means of most prior art impact devices have motion-limiting stops on the tool and matching stops on the tool holder to limit the maximum travel of the tool in the tool holder, and a tool retainer, which also serves as one of the stops, to prevent accidental expulsion of an unsupported tool. In many prior art devices, particularly larger units, additionally an anvil is interposed between ram and tool. An embodiment of such output means is schematically shown in FIG. 2. When the impact device is not operating and frame 12 is biased downward by an operator, frame 12 forces ledge 79 against anvil 57 which in turn presses tool 62 against workpiece 84.

However, when in operation, especially for devices in which the sharp down acceleration of ram 44 is obtained by reaction between ram 44 and frame 12, stop means 79 moves away from anvil 57. Thus, immediately prior to each impact no bias force holds the anvil to the tool nor the tool to the workpiece. Furthermore, friction between tool and tool holder urges the anvil clear of the tool and the tool clear of the workpiece. In addition, under strong impacting, especially on harder materials, the workpiece deflects and vibrates as an elastic body, and as a whole with respect to its supporting means. Such vibrations, plus the release of compression occurring in the tool and anvil caused by the impact, reflect back on tool and anvil and cause each to rebound. FIG. 2-B illustrates a typical position of frame, anvil, and tool relative to a workpiece just prior to impact of the ram as a result of such factors of frame reaction, friction and rebound.

Prior art devices have no means for eliminating such tool and anvil spurious movements, other than relying upon the operator applying sufficient bias force. For prior devices utilizing high performance power drive means with a resilient drive element as described hereinbefore, it is difficult or impossible with any reasonable bias force from the operator to hold stop means 79 against anvil 57 and thereby tool 62 firmly against workpiece 84.

The loss of efficiency and effectiveness from such spurious motions is serious. When an unsupported anvil or tool, is impacted either at rest pr in motion, only part of the ram kinetic energy and momentum is transferred. As much as 10 to 25% is dissipated or lost by vibrations and heating in such collisions. Also, the tool being cast toward the workpiece, the output means no longer acts by the hammer-chisel principle but by the less effectove pickax principle, with only the mass of the tool, without the ram, striking the workpiece, resulting in further loss of effectiveness.

FIGS. 2-C, 2-D, and 2-E show a sequence of typical unsupported collisions of ram to anvil, anvil to tool, and tool to workpiece respectively. At each of these respective collisions the energy and momentum of impact is degraded as described hereinbefore.

In many smaller prior art impact devices, no anvil is incorporated, the ram impacting the tool directly. Referring to FIG. 2-A, with anvil 57 omitted, as bias force is applied to frame 12 when the device is inoperative, ledge 86 presses tool collar 70 and hence tool 62 to the workpiece. For such devices, when in operation, ledge 86 moves away from collar 70 and except for no losses because of the absence of any anvil, the problems and deficiencies described hereinbefore are the same.

In addition to the aforementioned spurious tool motions, the frame, which has been forced away from contact with anvil or tool just prior to each impact as shown in FIG. 2-B, is then forced rapidly back to impact anvil 57, for example, as the ram is moved upward after each impact as shown in FIG. 2-A.

In a rapid succession of such direct frame impacts, the frame dynamic motion is highly non-linear and irregular, and the frame rebounds. This increase further the difficulties of holding the frame to the tool. If large enough bias force is applied to hold the frame rigidly against the tool just prior to contact, when the ram mass moves in a direction away from the workpiece, the center of mass of the entire impact device also moves away. Accordingly, starting from this higher position of center of mass, the tendency for the frame to move away from direct support of the anvil or tool is greater and the problem is increased.

While the foregoing description is illustrative of the dynamic situation occuring in typical state-of-art devices, the actual dynamics are much more complex and result in considerable net loss in energy and momentum and hence effectiveness in the output means of state-of-art devices incorporating a resilient drive element, and particularly a mechanical resilient drive element, in the power drive means.

As a partial solution of such problems in some prior devices, additional masses, including a cylinder reciprocated by crank-connecting rod means, are reciprocated with respect to the frame and in opposition to the ram reciprocating motion, to reduce the frame reaction motion, somewhat as in commonly used vibration dampers. Also, in some prior devices longer time periods between impacts is incorporated to improve the aforementioned conditions. Such partial improvments are heavy or can only be obtained at much lower impact rates, as low as half the commonly used rate, and accordingly restrict performance and do nothing significant to correct the initial removal of bias force from the anvil and/or tool caused by the sharp reaction motion of the frame immediately before impact.

In some prior art impact devices additional means are incorporated in the output means to accomplish certain results. Most common of such means are resilient relife means incorporated, especially on larger high impact devices. Such relief means usually include a slidable tool holder and relief coil springs, arranged to hold the tool holder against the frame during normal operation, and to relieve peak forces during operation with no tool or with the tool free of a workpiece.

Another arrangement, incorporated with output means on an electromechanical impact device disclosed in U.S. Pat. No. 973,216 (Oct. 18, 1910), is a relief spring arranged to hold the tool when idle, in a position to avoid ram impacting. To receive the ram impacting, the tool is pressed into position by a workpiece, which compresses the spring against the frame. Accordingly, this arrangement restricts frame motion and has the accompanying deficiencies discussed hereinbefore.

U.S. Pat. No. 1,107,550 (Aug. 18, 1914) shows another spring incorporated in a tool holder as part of an on-off air valve. The impact device operates when the tool is held against a workpiece and the spring is compressed to a limiyting stop to correctly locate the tool holder adjacent a duct opening. This restriction does not permit free reactive motion of the frame during operation and accordingly, has the aforementioned deficiencies.

Because of the deficiencies described hereinbefore, an improved device is much sought after. Thus, it would be advantageous to have a more efficient and effective device in which the high impacting capability of a ram is directed more toward accomplishing work and less to unnecessary random and spurious motions and collisions of ram, anvil, tool, and frame.

SUMMARY OF THE INVENTION

From the foregoing it is evident that, while the generation of ram action by resilient reaction against the frame of an impact device leads to higher impacting capabilities, it also leads to serious losses and deficiencies in the means used to put such high energy impacts to work.

The device of this invention incorporates means by which such deficiencies are eliminated and by which a greater proportion of such high energy, high momentum ram output is directed to accomplishing useful work.

An exemplary embodiment of the invention incorporates a high performance power drive means, having a resilient drive element in the form of air enclosed in a cylinder-piston air spring, to drive a ram, in the form of a piston with a shaft theron, into impacting as dislosed in copending application Ser. No. 534,626 filed Dec. 19, 1974, now U.S. Pat. No. 4,014,392.

An electric motor, through cranks and connecting rods, acts to reciprocate the cylinder, and because of the mass of the ram, generate successive impacts of the ram. While thus driving the ram into successive high impacts, the resilient drive element, the air, equally racts against the cylinder ends, connecting rods, cranks, and frame of the impact device and generates opposing rective reciprocating motion of the frame.

The high impacting capability of such power drive means is directed to accomplish work in the device of the invention, by incorporating output means which, while applying the rapid succession of high impacts to a tool, force the tool firmly and continously against a workpiece, and thereby actually provide the more effective and efficient hammer-chisel action.

On larger impact devices, such output means of the invention comprise a tool holder, a resilient relief means, a tool, an anvil, a releasable retainer, and a resilient bias means. The tool holder, which is slidably mounted for movement in a direction away from the workpiece, is held firmly to the frame of the impact device during normal operation, by any of several well known and commonly used resilient relief means, such as relief coil springs, incorporated to accept the ram impacting for operation without a tool or with the tool free of a workpiece.

The tool is mounted in the tool holder to have freedom for reciprocating movement between spaced stops substantially in the direction of the ram motion. A commonly used releasable retainer, which forms one of such stops, prevents an unsupported tool from being rejected from the holder and can be released to remove the tool. The anvil is mounted on the tool holder to have substantailly the same direction and freedom for reciprocating motion between spaced stops. The anvil is located between the ram and the tool to receive the ram impacts and transmit the results therefrom to the tool.

The resilient bias means, interposed between the frame and the anvil, comprises a bias coil spring, a supporting ledge on the anvil and a matching supporting ledge on the frame. The bias coil spring, or resilient element of the resilient bias means, is compressed between such supporting ledges and has length and stiffness to continously force the anvil against the tool, and thence force the tool continuously against the workpiece, while supporting the frame and tool holder within the medial range, between motion limiting stops, of their maximum free travel with respect to anvil and tool during normal operation of the impact device, while bias force, within a normal range of operating values, is applied to the frame. Adequate spacing between the aforementioned limiting stops is provided, to allow for variations in bias force and dynamic conditions experienced while operating under varying conditions, by spacing the stops to provide several times as much free travel between such limiting stops as any normally expected reactive reciprocating travel of the frame with respect to the tool or anvil.

Bias force is applied on thr frame by gravity and/or by an operator or other suitable means. When the impact device is in operation, part of such bias force, the frame bias force, overcomes the deficiency of the rate of momentum at impacting, and the remainder of such bias force, the tool bias force, passes from the frame through the bias spring of the invention to the anvil, therby continously forcing it against the tool and thence forcing the tool continously against the workpiece. With the anvil, tool and workpiece thus forced together continously throughout each normal working cycle, the more effective hammer chisel action is obtained and all free space collisions between ram, anvil, and tool, as well as all spurious frame motions caused by impacting against rigid stops, are eliminated.

In some embodiments of the invention, especially for smaller ones, no anvil is incorporated, the resilient bias means being incorporated directly between tool and frame or with a simple barrel shaped tool guide interposed between bias spring and tool. In such embodiments bias spring stiffness and length, and spacing between motion limiting stops, is provided to support the frame in a position to provide for free reactive motion of the frame without contact with motion limiting stops as described hereinbefore. In addition, in other embodiments, usually for smaller impact devices, no resilient relief means is incorporated. The presence of the resilient bias means increases insignigicantly the stiffness required for the resilient relief means but has no other interrelation therewith.

The improvements of the invention, as obtained by the exemplary embodiment can also be obtained with other power drive means and with other resilient means incorporated in the resilient bias means.

Other well known and commonly used high performance, light weight power drive means, having a resilient drive element through which ram motion is generated and which reacts against the frame, are available from the prior art and can be embodied as power drive means in the device of the invention, instead of the cylinder-piston air spring of the exemplary embodiment. Embodiments incporating pneumatic power drive means with compressed air for the resilient drive element, one embodiment with an anvil and one without, and an embodiment incorporating power drive means with a cam and a solid material spring as resilient drive element, are disclosed. Additionally, hydraulic drives, with the pressurized fluid being the resilient driving element, and other reciprocating cylinder-piston means, with the enclosed air as a resilient drive element, can be incorporated as the power drive means.

Other resilient means which can be embodied in the resilient bias means of the invention include air springs, multiple coil springs, tension springs or other such means which can provide the support and resilience needed. An embodiment incorporating an air spring with a cylinder piston drive means and one incorporated with a pneumatic power drive means are disclosed.

Improvements gained by the device of this invention are several: (1) the tool is held firmly against the workpiece throughout each working cycle and acts to continously provide the more effective hammer-chisel action; (2) both anvil and tool are held firmly together and both firmly against the workpiece, there being thus no loss from multiple free floating collisions, higher efficiency of impacting thereby being attained; (3) the frame is supported on resilient bias means, and the motion limiting stops are so located that the frame reciprocative motion during normal operation experiences no losses from frame impacting against substantially rigid stops; and (4) being thus supported, the frame reciprocates more stably, therefore requireing less bias force than for comparable prior art devices.

Other objects and advantages of the present invention will become more apparent from a consideration of the following detailed description and claims in conjunction with the accompanying drawings.

DETAILED DESCRIPTION OF THE PREFERRED EMBODIMENTS

Figure 2:
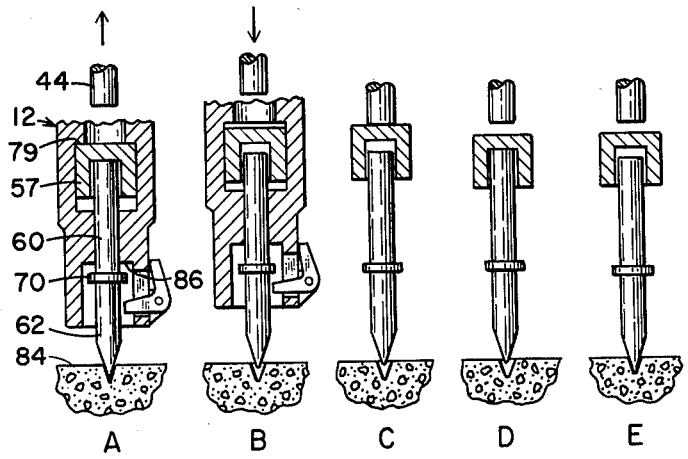
FIG. 2 illustrates dynamic effects of prior art devices.
Figure 1:
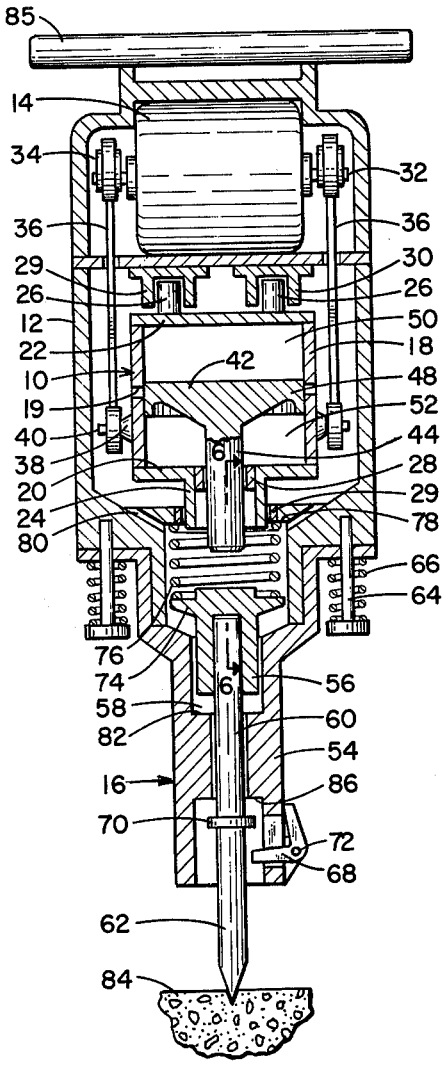
FIG. 1 is a sectional view of an impacting device according to the invention incorporating a cylinder-piston resilient drive element and anvil.

Referring to the drawings, FIG. 1, illustrates a preferred embodiment of the invention incorporating a modified embodiment of a power drive means disclosed in copending application, Ser. No. 534,626 filed Dec. 19, 1974.

A cylinder-piston means 10 is mounted for reciprocation on frame 12, which also serves as an enclosing case. Near the upper end of frame 12 power means, in this embodiment rotary motor 14, is secured. Output means 16 is located at the opposite end of frame 12. Cylinder-piston means 10 comprises a barrel 18 together with enclosing end elements 20 and 22 secured thereto. End element 20 has barrel 24 secured thereto substantially concentric with barrel 18, and end element 22 has two cylinders 26 secured thereto and positioned substantially symmetrically on opposite sides of the axis of barrel 18. Cylinders 26 are slidably fitted in matching barrels 29 and 30, with end flanges thereon secured to frame 12. Barrel 24 and cylinders 26 are positioned to have all respective axes substantially parallel with the axis of barrel 18 and thereby form guides acting to confine the reciprocation of barrel 18 substantially to linear motion along the principal axis of frame 12, with no substantial rotation about any axis and with sliding supports at both ends of cylinder-piston means 10. Vent holes 80 in frame 12 provide for free flow of air between the respective chambers of frame 12 closed off by frame ledge 78, barrel 24, and bushing 29.

The rotary output of motor 14 is converted to linear motion by drive mechanism, in this embodiment shaft 32 having two cranks, here shown as eccentrics 34 pressed and keyed to each end portion of shaft 32 in substantially the same rotational phase, and connecting rods 36. The power means and drive mechanism comprising motor, shaft, eccentrics and connecting rods are arranged to be substantially balanced and symmetric.

The connecting rods are interconnected to barrel 18 by supports 38 and wrist pins 40. The linear motion induced in cylinder-piston means 10 causes piston 42, slidably and sealably fitted therein, to reciprocate by action of the resilient drive element, air, enclosed in cylinder-piston means 10. Piston shaft 44 protrudes slidably and sealably through bushing 28 in end element 20 and transmits the reciprocating motion of the piston outside cylinder-piston means 10. Piston 42 and shaft 44, fixedly secured thereto, act as a ram means, or ram.

Piston 42 divides cylinder-piston means 10 into an upper chamber 50 and a lower chamber 52, the piston and chambers 50 and 52 thereby forming a double air spring. Limited air flow passes through the cylinder wall through restrictive vents 19 located in the medial region of the cylinder length. These vents act to stabilize the piston mean travel position. Piston 42 has a tapered web and lightweight depending skirt 48 to give it high strength in the axial direction.

Output means 16 receives the ram motion as an impact at the end of each reciprocation of the ram and applies the result of the impacting to accomplish work on the workpiece. The output means comprises tool holder 54, tool 62, anvil 56, resilient relief means, and resilient bias means.

Tool 62 is mounted for reciprocation in tool holder 54 substantially in the same direction as the ram movement; and anvil 56 is mounted for reciprocating movement in a cylindrical opening 58 in tool holder 54 and also substantially in the same direction as the ram movement. Anvil 56, which has a barrel portion enclosed at one end, and anvil collar 74 secured near the closed end thereof, fits slidably over the end of shank 60 of tool 62. Shank 60, the matching opening in tool holder 54 and anvil 56 usually, but not necessarily, have a hexagonal or some such cross sectional shape to prevent rotation with respect to holder 54, of tool 62 and anvil 56 about their principal axes.

The output means 16 incorporates a well known and commonly used resilient relief means having tool holder 54 slidably attached to frame 12 and to pins 64 for movement in a direction substantially in the direction of the ram movement. Pins 64, secured to frame 12, hold relief springs 66 in compression, and thereby tool holder 64 firmly against frame 12. The resilient relief means provides relief from excessive loads caused by ram impacting during operation with no tool in holder 54 or with the tool unsupported by a workpiece.

Releaseable retainer 68 pivoted on tool holder 54 prevents tool 62, having collar 70 secured thereon, from being ejected when the device is operated without support of tool 62 on a workpiece. Retainer 68, which may be any well known and commonly utilized retainer having means to hold it in operating position, may be rotated about pin 72 for removal of the tool when the device is not in operation. Retainer 68 and tool holder ledge 86 are motion limiting stops which, with collar 70 are spaced to provide adequate maximum reciprocating excursion of tool 62 with respect to tool holder 54 and hence frame 12 during normal operation as disclosed hereinafter.

Matching tool holder ledge 82, preferably stops the movement of anvil 56 into opening 58 of tool holder 54 to prevent anvil collar 74 from contacting tool holder 54 when anvil 56 moves into opening 58 the maximum distance, thereby transmitting the impact force directly to tool holder 54 through the barrel portion of anvil 56 rather than through anvil collar 74 when the impact device is operated with no tool or with the tool unsupported by a workpiece.

The resilient bias means comprises anvil collar 74, a metching ledge 78 secured on frame 12, and bias spring 76. The latter, in the form of a compression type coil spring, with an internal diameter greater than the outside diameter of barrel 24, is interposed between anvil collar 74 and frame ledge 78 substantially concentric with barrel 24 and ram 44.

Since in normal operation, as disclosed hereinafter, bias spring 76 holds anvil 56 against tool 62, the maximum free travel of anvil 56 with respect to frame 12 is determined by one limiting stop with anvil 56 against ledge 82 and the other stop with tool collar 70 against ledge 86.

A length and stiffness for bias spring 76 is provided to support frame 12, by ledge 78, in the medial range of maximum travel of the frame with respect to tool 62 and anvil 56, such support to provide free reciprocating motion of frame 12 or tool holder 54 free of contact with motion limiting stops 68 and 86 or 82 and 86 respectively for collar 70 and anvil 56, during normal operation of the impact device, with tool 62 held against a workpiece with average operating bias force applied through the frame to bias spring 76. The length and stiffness of bias spring 76 preferably are adequate to provide compression to hold anvil 56 against ledge stop 82 when there is no tool in holder 54. Relief springs 66 preferably have sufficient length, stiffness and pre-compression to hold tool holder 54 in contact with frame 12 against the force of bias spring 76 during normal operation.

With such arrangement of resilient bias means, when the impact device is not in operation and tool 62 rests against workpiece 84, and bias force is applied to frame 12 by gravity and/or an operator or other means, such bias force is exerted through the frame to frame ledge 78, in the direction of the workpiece, through bias spring 76 to anvil 56 and thence to tool 62 to urge the latter firmly against the workpiece. During operation, a component of the total bias force, herein referred to as the frame bias force, counteracts the rate of momentum deficiency caused by the impacting as discussed hereinafter. The remaining component of bias force, herein referred to as the tool bias force, is continously, throughout each working cycle, transmitted to anvil collar 74, thereby pressing anvil 56 continously and firmly against tool 62 which in turn is urged, continuously and firmly, against workpiece 84. In this way bias spring 76 acts to hold anvil 56 and tool 62 together as a unit, which is then held firmly against workpiece 84 while frame 12 and tool holder 54 reciprocate freely within the resilient range of the resilient means of the resilient bias means, free of contact with any limiting stops.

During normal operation, the total bias force, a part of which may be applied, for example, by an operator, will usually vary over a considerable range. To allow for such variation and for variations in workpiece characteristics, which will change the amount of compression of bias spring 76, and therefore the mid excursion position of frame 12 with respect to tool 62, spacing between motion limiting stops, as described hereinbefore, is provided for relative maximum travel between tool and frame (or tool holder) and between anvil and frame (or tool holder) to be several times the expected dynamic excurison of frame 12 (or holder 54) with respect to tool 62. Experience has shown five or more times the expected excursion to be practicable.

Such spacing allows the frame and tool holder to reciprocate freely without contacting any limiting stop, in response to the reactive forces imposed on it by the sharp expansion of the resilient drive element of the power drive means.

During operation, cylinder-piston 10 is driven to linear reciprocation by action of the motor, crankshaft, and connecting rods, thereby inducing piston and shaft (the ram) into reciprocating motion. The location of anvil and tool with respect to the ram impacting location for more effective impacting is determined by the characteristics of the particular arrangement of cylinder-piston incorporated.

Immediately after each impact, because of ram inertia, up motion of the cylinder rapidly increases the air pressure in chamber 52, thereby pushing up on the piston and simultaneously pushing down on cylinder end element 20 and through cylinder 18 and connecting rods 36, to move frame 12 down. With the arrangement of the invention frame 12 is held, by bias spring 76, in position to provide for reciprocating reactive motion of frame 12, including all elements of the impact device except anvil and ram, free of contact with any limiting stop. The frame is then free to move against the resilience of bias spring 76, in accordance with the physical principle of action and reaction, and frame 12, and, hence all attachments thereto, will move downward a distance substantially equal to the distance moved upward by ram 44 reduced by the inverse ratio of their relative masses, except as modified by masses reciprocating relative to the frame as described hereinafter.

Next, in a cycle of operation, the upward velocity of the ram mass must be stopped and accelerated sharply downward to high impact velocity by action of the cylinder as described hereinbefore for the upward motion, except the pressure in chamber 50 acts to push the ram down and the frame up. Since there is no impact during this phase of the cycle, the reaction force on the frame acts longer and stronger to move the frame up further. Frame bias force is applied to the frame to make up the difference.

To be useful, energy is given up at impact, the rebound velocity, $V_r$, is determined by the energy extracted from the ram motion during the impact. In a typical device the rebound velocity is less than half the incident velocity, $V_i$, and often is one third. In addition, there is a deficiency of momentum. The ram has less momentum up than down. The pressure in chamber 50 acting on piston 42 over the time of its application, supplies such deficiency of momentum. At the same time this same pressure in chamber 50, acting on end element 22 through the cranks and connecting rods acts to move frame 12 up in reaction thereto as mentioned hereinbefore.

To prevent the frame from "floating" away from the workpiece, for a succession of impacts, frame bias force, $F_f$, is applied in a direction toward the workpiece to counteract the time rate of momentum deficiency. Averaged over a typical working cycle, $F_f$ is equal to $M(V_i - V_r)(n)/g$, where M is the mass of the ram, $n$ is the number of impacts per second, and $g$ is the acceleration of gravity. The total bias force is equal to $F_f$ plus the tool bias force transmitted by the bias spring, and is applied on the frame or handle by gravity and/or an operator or other suitable means. This fundamental relation, accurately predicts the necessary total bias force for the device of the invention which has eliminated the spurious and complicating effects, arising when the frame strikes rigid stops as in prior art devices described hereinbefore.

There will be changes in the compression of the bias spring because of such small frame movement and by any variation of bias force applied by the operator, but such changes are relatively insignificant compared with the forces which induce the frame reciprocating motion described.

The reciprocating motion of the cylinder and connecting rod masses with respect to the frame causes an additional oscillatory motion of the center of mass of the frame and elements secured thereto, which will add or subtract to the frame reactive motion described hereinbefore, the amount being determined for the power drive means incorporated by the phase relation between cylinder and ram motion. Such additional oscillatory motion is taken into consideration when providing for adequate free reciprocating travel of the frame in relation to the tool holder, anvil and other related stops. It is also evident that the net excursion of the frame and the tool holder can be made minimal by rpoviding elements of such device which determine the phase of the reciprocating motion of the cylinder, nearly opposite in phase to the reciprocating motion of the ram, an advantageous means for reducing the frame motion.

In contrast, in prior art devices for which the bias force presses a frame or tool holder ledge rigidly against an anvil and/or a tool collar, in a non-resilient contact, if the bias force is large enough and the period of operation is long enough, so that the frame ledge is held against the tool collar during this phase of the cycle, the frame cannot move down or further toward the workpiece. Hence as the ram moves up or away from the workpiece, the center of mass of the entire device is raised. As a result, for the next phase of operation in prior devices, the frame must start from a less favorable position, already moving, or moved, in the direction it will be further moved or accelerated by the strong reaction of accelerating the ram to impacting.

While this preferred embodiment of the invention incorporates a particular power means and drive mechanism for reciprocating a particular cylinder-piston air spring arrangement, it is evident that any of many such cylinder-piston air spring arrangements and drive mechanisms known by those skilled in the art, can also be satisfactorily incorporated with the resilient bias means as described herein to obtain such improvements. Further, the tool, shown here as a pointed bit commonly used for concrete demolition, can be any type of impact tool.

Figure 3:
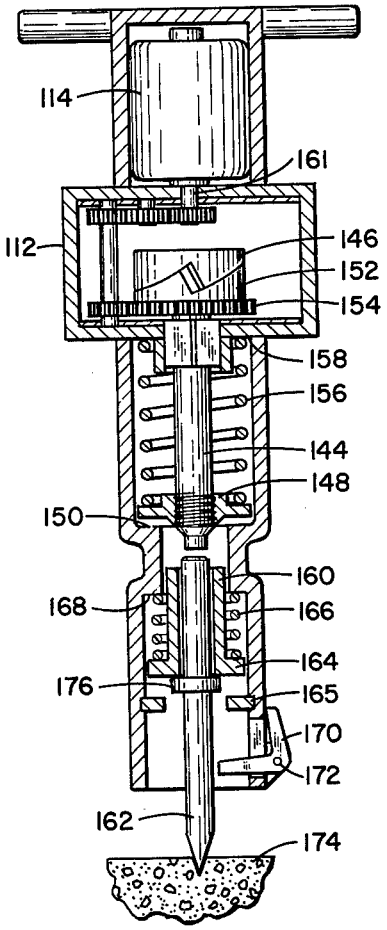
FIG. 3 is a sectional view of an embodiment incorporating a cam drive with a coil spring as resilient drive element.

FIG. 3 illustrates a second embodiment of the invention incorporating power drive means comprising a commonly used cam drive mechanism and a solid material spring for a resilient drive element. In this embodiment frame 112 has electric motor 114 mounted thereon. Ram shaft 144 is mounted for reciprocating motion along its axis, substantially collinear with the axis of frame 112. Means are illustrated for preventing rotation of shaft 144 about its axis with respect to frame 112 while providing axial motion, by means of a square cross-section portion of shaft 144 fitted in a matching lateral section of frame 112. Saw tooth cam head 146 is secured to the top end of shaft 144 and spring support 148 is secured to the lower end by suitable means and serves as a stop for restricting downward motion of shaft 144 by ledge 150 on frame 112. Matching saw tooth cam 152 and gear wheel 154 secured thereto are mounted on shaft 144 for rotation thereon. Gear wheel 154 is geared to be rotated by motor 114 by a gear train comprising two pinon gears on a counter-shaft and two additional pinon gears, one attached to the motor shaft 161 and rotated thereby, and another on an idler shaft. A resilient drive element, in the form of compression spring 156, is mounted between spring support 148 on shaft 144 and ledge 158 on frame 112.

In this embodiment, the resilient bias means includes barrel shaped tool holder 160, slidably mounted in the frame and with larger diameter section or collar 164 at its lower end, frame ledge 168, and bias spring 166 interposed between collar 164 and frame ledge 168. Tool holder 160 is slidably mounted in frame 112 and shank of tool 162 is slidably mounted in the tool holder, both holder and tool being slidably mounted for motion substantially aligned with the ram motion. The cross section of both matching fits are preferably hexagonal or other such shape to prevent tool and tool holder from relative rotation. Releasable tool retainer 170 provides a tool motion stop and can be released for tool removal as described hereinbefore. Removable ring 165 acts as a stop to limit outward movement of tool guide 160. Tool guide 160 is located so that tool 162 is hold in position to receive impacting from ram 144.

Rotation of motor shaft 161 through the gear train rotates gear wheel 154 clockwise as viewed from the motor, and with it, cam drive 152 thereby raising cam head 146, shaft 144 and spring support 148, and thereby compressing spring 156. As the matching saw tooth cams pass their respective peaks, cam head 146 and shaft 144 are released and spring 156 rapidly accelerates ram shaft 144 and attached parts, into impact against tool 162. Simultaneously, as with the embodiment of FIG. 1, the reaction of spring 156 also pushes against ledge 158 on frame 112 and acts to move frame 112 in reaction thereto in a direction away from the workpiece.

Bias spring 166, positioned between frame ledge 168 and tool guide flange 164, performs the same functions as performed by bias spring 76 of FIG. 1. Thus, all related limiting stops are spaced sufficiently to provide full free travel of the rame relative to the tool and tool guide, and bias spring 156 has length and stiffness to support the frame within the medial range of free travel relative to the tool while also providing adequate bias on the tool to hold it against the workpiece for all normal operating conditions with a normal range of bias force applied to the frame. In operation bias force applied to frame 112 presses ledge 168 against bias spring 166 which in turn presses tool guide 160 against tool collar 176 which thereby holds tool 162 firmly to the workpiece 174 with the improvements described hereinbefore.

Again, while this embodiment has been described as utilizing a particular means for compressing and releasing a resilient drive element in the form of a coil spring, it is evident that any of many similar commonly utilized mechanisms incorporating any solid material spring means as well as any other resilient drive element as disclosed herein, can also be utilized to obtain the improvements of the invention.

Figure 4:
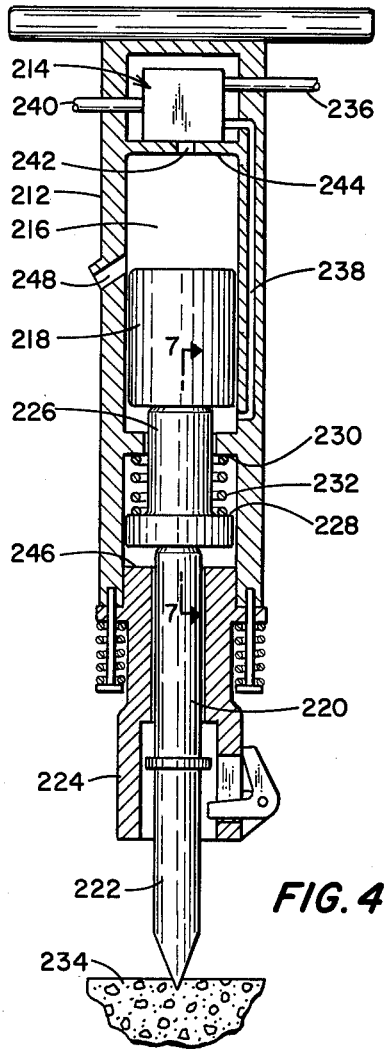
FIG. 4 illustrates an embodiment incorporating a pneumatic drive and an anvil.

FIG. 4 illustrates a sectional view of a third embodiment incorporating the principles of the invention with power drive means in a form of the well known and commonly pneumatic drive. Cylinder chamber 216 is formed in frame or casing 212 which also has valve mechanism 214 mounted thereon. Piston 218 is slidably and sealably mounted for reciprocation in cylinder 216. Tool holder 224 is slidably mounted on the lower end of frame 212 to hold tool 222 substantially in axial alignment with piston 218. The cross section of the opening for holding the tool and the tool shank preferably but not necessarily are hexagonal to prevent rotation of the tool about its axis. A collar on tool 222, a releasable retainer and retainer springs serve the same purpose as similar devices on embodiments described hereinbefore. Anvil 226, with ledge 228 formed thereon, is slidably mounted on frame 212 between piston or ram 218 and tool 222 acting to receive impacts from ram 218 and transmit the force to tool 222.

Resilient bias means including bias spring 232, positioned between ledge 230 on frame 212, and ledge 228 on anvil 226, foces anvil 226 against tool 222 to hold it firmly against workpiece 234 when bias force is applied to the impact device when held in working position against a workpiece.

This embodiment operates thus: Compressed air enters duct 236 from an air pressure source, not shown. Through action of valve mechanism 212, which can be any of a number available in the prior art, such compressed air, the resilient drive element, is directed through duct 238 to move piston 218 up while air above piston 218 is exhausted through duct 240. At the same time frame 212 being suspended on bias spring 232 moves down as described hereinbefore. As piston 218 nears the top of its travel, it is decelerated and sharply accelerated down by higher pressure air fed through duct 242. Here, as for previously described embodiments, the air pressure in the space above piston 218 also acts on wall 244 to moe frame 212 upward in reaction to the downward motion of piston 218. As piston 218 reaches its lowest position, excess air is exhausted through duct 248.

Such upward motion of frame 212 also moves frame ledge 230 upward. However, bias spring 232 of the invention continues to maintain substantially the same bias force on anvil 226 and hence hold it firmly to tool 222 which is then held firmly to workpiece 234. The spacings of ledge 230, length and stiffness of bias spring 232 and location of anvil ledge 228 and stop ledge 246 as well as the travel distance between structural stops for the tool collar are all arranged as described hereinbefore so that during normal operation, while continuously transmitting tool bias force, bias spring 232 supports the frame within the medial range of its reciprocating travel so it can react freely without contact with any structural stops during normal operation.

While this embodiment utilizes a particular pneumatic drive means, it is evident that any such well known and commonly utilized pneumatic drive means available from the prior art can be utilized in place thereof.

Figure 5:
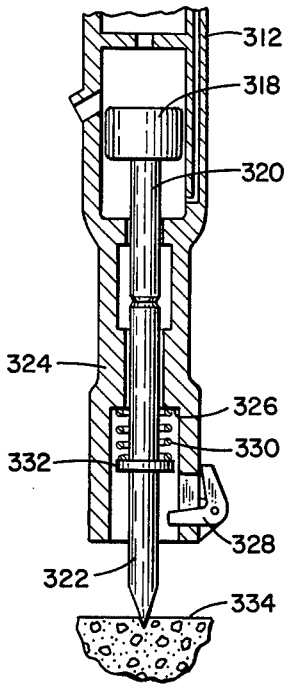
FIG. 5 illustrates another embodiment incorporating a pneumatic drive with no anvil.

FIG. 5 shows a fragmentary sectional view of another embodiment utilizing a pneumatic drive means. In this embodiment piston 318, formed to fit slidably and sealably in a cylinder formed in frame 312, has a shaft 320 attached thereto which passes slidably and sealably through an opening in frame 312 to impact against tool 322, which is held in position by tool holder 324 formed in frame 312.

The resilient bias means in this embodiment includes frame ledge 326, tool collar 332, and bias spring 330 interposed therebetween. Ledge 326 is located at sufficient distance away from releasably retainer stop 328, which functions in a similar manner as described hereinbefore, to provide spacing for interposition of bias spring 330 between frame ledge 326 and collar 332, and also to provide adequate spacing for free reactive travel of frame 312 during operation as described hereinbefore.

Spring stiffness and length of bias spring 330 is provided to hold tool 322 firmly against workpiece 334 while also supporting the frame, when bias force is applied to it, to position tool collar 32 substantially within its mid-travel position so bias spring 330 will not "bottom", nor flange 332 contact retainer stop328 during normal operation as described hereinbefore for the embodiment of FIG. 1.

It is evident that any of many typical prior art pneumatic drive means can be incorporated in the foregoin embodiment in place of the particular means described.

The embodiments described hereinbefore all incorporate a resilient means in the resilient bias means in the form of one compression-type coil spring supported between frame and tool. While design considerations and practive show the compression-type spring to be a preferred resilient means, it is evident that resilient means in other forms may be incororated as well, including two or more compression-type coil springs, tension type coil springs, and springs in any form which can provide the necessary resilience, and the necessary stiffness as well. For example FIGS. 6 and 7 illustrate two embodiments of an air spring, each of which, as arranged, can provide the effects and results, and hence the improvements typical of this invention.

Figure 6:
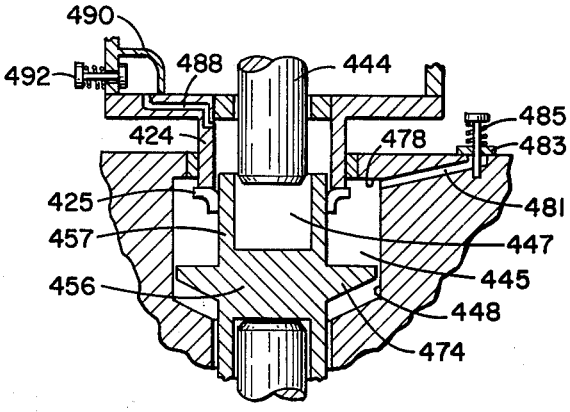
FIG. 6 is an enlarged fragmentary, somewhat diagrammatic sectional view of a modified form of the invention along line 6—6 of FIG. 1 showing an air spring for resilient bias means incorporated with a cylinder-piston resilient drive element.
Figure 7:
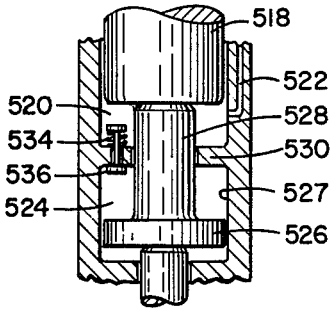
FIG. 7 is an enlarged fragmentary, somewhat diagrammatic sectional view of a modified form of the invention along line 7—7 of FIG. 4 showing an air spring for resilient bias means incorporated with a pneumatic drive.

FIG. 6 is an enlarged fragmentary, somewhat diagrammatic, sectional view illustrating a modification of the embodiment of FIG. 1 incorporating a bias air spring in place of the coil bias spring 76. In this, anvil 456 is similar to anvil 56 of FIG. 1 except it has a barrel 457 extending upward which slides past barrel 424 which replaces barrel 24 of FIG. 1. Barrel 424 has been lengthened, to extend past the top of the barrel 457 and has an internal diameter sufficiently larger than the diameter of shaft 44 to allow for clearance and for air flow therethrough. A one way circular flap seal 425 is attached to the lower end of barrel 424. Anvil collar 474 is sealably and slidably fitted in cylindrical opening 448 to reduce the passage of air from chamber 445 to the space below the collar. Ducts 80 are eliminated and replaced by a single duct 481 which has a one way check valve 483 with loading spring 485.

This bias air spring embodiment operates as follows: Reciprocating action of ram 444 and barrel 424 when moving downward act to compress the air in chamber 447. This is sealed by one way seal 425 which permits flow from chamber 447 to chamber 445 but not reversely. Check valve 483, at the outlet end of duct 481 is set to stop all flow below a suitable pressure, determined by spring 485, and exhausts the surplus air to thereby maintain the presure in chamber 445 at the substantially desirable pressure.

Air is admitted to chamber 447 formed by barrel portion 424 and anvil barrel 457 through duct 488, valve housing 490, and spring loaded check valve 492 which opens only for flow into chamber 447. This embodiment, then is a pumping arrangement which maintains the pressure in chamber 445 to press against anvil 456 and anvil collar 474 and frame ledge 478 and thereby function substantially as coil bias spring 76 in the embodiment of FIG. 1.

The air pressure in chamber 445 is greater than the air pressure below anvil collar 474, hence this arrangement acts to keep dust from entering the mechanism above collar 474.

FIG. 7 shows an enlarged fragmentary somewhat diagrammatic sectional view of a modification of the embodiment of FIG. 4 in the form of an air bias spring with a pneumatic drive means. In this embodiment, bias spring 232 of FIG. 4 has been eliminated, anvil collar 526 is sealably and slidably fitted into the housing cylindrical opening 527 and anvil body 528 sealably and slidably fits into an opening in frame support 530. Frame support 530 also has check valve 536 with spring 534. Chamber 520 sealed off by ram 518, and frame support 530 is pressurized by surges of pressure from duct 522 which provides presure primarily acting to raise ram 518 after each impact as described hereinbefore, With this surge of pressure in chamber 520, spring 534 is overcome and air is admitted into chamber 524 and acts to raise its average pressure to a predetermined value. Reverse flow is prevented by valve 536. With this arrangement the air pressure in chamber 524 functions as a bias air spring as described for the embodiment of FIG. 6. If the air pressure tends to become too high or erratic for the arrangement as described, a second check valve (not shown) can be fitted in the wall of opening 527 to exhaust air to the outside.

In conclusion, it is evident that the resilient bias means of the invention which includes resilient means interposed between a frame support and a tool or anvil support, with motion limiting stops spaced to provide adequate free travel between stops and with resilient means stiffness sufficient to support the frame in free motion within the medial region of such spaced stops during normal operation with normal total bias force applied, can be incorporated with many sufficiently light weight power drive means having a resilient drive element therein which are available in the prior art, and that effect sharp action and reaction motions necessary for effective successive ram impacting, but which in doing so create the difficulties accompanying tool bounce and instabilities experienced in prior art devices, which difficulties are eliminated by incorporating the resilient bias means of the invention.

Such power drive means preferably include any suitable cylinder-piston arrangement or spring, any solid material spring, or metal coil spring, any pneumatic or compressed air system, any pressurized hydraulic system, or any other such mechanical resilient drive element incorporated in a power drive means which is light in weight and can deliver rapid successive ram impacts by reaction against the frame through such resilient drive element of the device. In addition, it is evident that the impact device of the invention can be powered by an elecric, pneumatic, or hydraulic motor including rotary or linear types, or by a mechanical shaft drive, and that the power drive means can comprise any suitable means for applying the power to reciprocate the ram means including connecting rods for reciprocating cylinder-piston arrangements, or valving and ducting to actuate a pneumatic or hydraulic resilient drive element.

It is also evident that the principles of the resilient bias means of the invention can be incorporated in the impacting mechanism of rotary hammers and other such impact devices which incorporate power drive means and related mechanisms arranged as disclosed herein.

Further as disclosed hereinbefore, the resilient bias means through which the bias force acts to stabilize the tool and anvil and to hold them firmly to the workpiece and simultaneously to provide support for the frame away from the workpiece so the frame can reciprocate freely without contacting limiting stops, can be one or more coil springs, either compression or tension type, an air spring, or other suitable resilient means.

The improvements and advantages obtainable by the device of the invention, because of the stabilized action of the tool and frame obtainable thereby, are substantially uneffected by impact rate over a wide range; accordingly relative improvement of the device of the invention increases with increase in impact rate.

In addition, for all embodiments described herein the tool which is shown with a pointed working end, can be any type of impact tool including a chisel blade, spade, tamper, or rivet set.

Finally, in the foregoing disclosures, statements about the motion and mass of frame 12 hereinbefore are understood to refer to the motion and mass of frame 12 plus all elements secured thereto and which move therewith. Also, reference has been made to the device being held with the principal axis of the ram vertical and the device held over a workpiece. When so held, the weight of the device less tool and anvil, if used, provide all or part of the total bias force. It is also evident that the device of the invention will operate equally well if held in any position. In such cases the directions referred to as up or down are equivalent respectively to away from and toward the workpiece.

Having thus described the invention, the following is claimed:

1. An impact device for operation with bias force applied toward a workpiece and comprising:

a frame, ram means mounted for reciprocation along a selected axis relative to said frame, power drive means acting between the ram means and the frame for generating the reciprocation of said means by generating reactive reciprocative excursions of said frame along such selected axis, output means comprising impact tool means operatively mounted in tool guide means for reciprocating movement relative to said frame substantially along such selected axis, said impact tool means positioned for receiving successive impacts from said ram means during reciprocation of the latter, and stop means acting between the frame and the impact tool means for limiting relative travel between the frame and the tool means, wherein the improvement comprises:

stabilizing means for eliminating frame dynamic impacting against the stop means, for stabilizing the frame reciprocative motion, and for increasing the impact device effectiveness and efficiency with improved hammer-chisel type impacting during operation; said stabilizing means comprising:

said stop means including frame stop means secured on said frame and tool stop means secured on said impact tool means sufficiently spaced respectively along such selected axis for sufficient maximum relative travel between said frame and said impact tool means for free dynamic excursions of said frame relative to said impact tool means clear of substantial contact between said frame stop means and said tool stop means during normal operation of the impact device including operation with such bias force applied and with said impact tool means substantially in constant contact with such workpiece, resilient bias means operatively interposed between said frame and said impact tool means, said resilient bias means having sufficient spring stiffness and sufficient length to maintain said impact tool means substantially in constant contact with such workpiece during such normal operation of the impact device and to resiliently suspend said frame within the medial portion of said maximum relative travel substantially clear of restrictive contact between said tool stop means and said frame stop means for free dynamic excursions of said frame relative to said impact tool means during each normal operation of the impact device, such free dynamic excursions including the reactive reciprocative excursions of the frame and excursions from dynamic response of the frame as resiliently suspended on the resilient bias means with such bias force applied, and said resilient bias means having sufficient resilience and length for such substantially free dynamic excursions of said frame during such normal operation of the impact device.

2. An impact device as claimed in claim 1 further comprising:

said output means further comprises tool guide means slidably mounted for limited movement relative to the frame substantially along such selected axis, resilient relief means interposed between said tool guide means and said frame, said resilient relief means constructed and arranged to urge said tool guide means toward the frame thereby to hold said tool means firmly to said frame during operation of said impact device with said impact tool means in contact with such workpiece, and to relieve ram impacting forces imposed on said frame during operation of said impact device with said tool free of such workpiece.

3. An impact device as claimed in claim 1 wherein:

the maximum travel of said frame relative to said impact tool means between said spaced stop means is several times such reciprocal reactive excursions of said frame during normal operation of said impact device.

4. An impact device as claimed in claim 1 wherein:

the maximum travel of said frame relative to said impact tool means between said spaced stop means is at least five times such reciprocal reactive excursions of said frame during normal operation of said impact device.

5. An impact device as claimed in claim 1 wherein:
said resilient bias means has substantially constant spring stiffness throughout the operable deflection range thereof during operation of the impact device.

6. An impact device as claimed in claim 1 wherein:
said resilient bias means comprises a ledge on said impact tool means facing away from such workpiece with said impact device in position for operation, a ledge on said frame facing toward said ledge on said impact tool means, and said resilient means interposed between said ledge on said impact tool means and the ledge on said frame.

7. An impact device as claimed in claim 6 wherein:
said resilient means comprises at least one coil spring.

8. An impact device as claimed in claim 1 wherein:
said power drive means comprises a cylindrical chamber in fixed relation to the frame, a piston slidably and sealably fitted for axial reciprocation in said cylinder along such selected path, pneumatic drive means operatively connected to reciprocate said piston, and
said ram means comprises said piston.

9. An impact device as claimed in claim 1 wherein:
said power drive means comprises cam means operative to alternately compress and release such compression of said resilient drive element and thereby acting to reciprocate said ram means to impacting motion while acting to reciprocate said frame in reaction thereto during operation.

10. An impact device as claimed in claim 9 wherein:
said resilient drive element comprises at least one coil spring.

11. An impact device as claimed in claim 1 wherein:
said resilient bias means further comprises said tool guide means slidably mounted on said frame for movement substantially along said selected axis, a ledge on said tool guide means, a ledge on said frame, and at least one bias coil spring compressed between said ledge on said tool guide means and said ledge on said frame.

12. An impact device as claimed in claim 1 wherein said power drive means comprises a piston-cylinder enclosing a substantially constant quantity of air therein, said ram means comprising said piston slidably and sealably mounted for reciprocation in said cylinder, at least one end element on said cylinder, exciter means to reciprocate said at least one end element thereby generating the reciprocation in said piston and the reciprocal reactive excursions of said frame.

13. An impact device for operation with bias force applied toward a workpiece and for generating and transmitting successive impulsive forces to the workpiece, said impact device comprising:
a frame,
ram means mounted in said frame for reciprocation along a selected axis relative to said frame,
power drive means comprising exciter-reciprocative means for driving a reciprocating body into reciprocation along said selected axis and a resilient drive element operatively interposed between said reciprocating body and said ram means, said power drive means for generating the reciprocation of said ram means by generating reciprocal reactive excursions of said frame relative to said impact tool means along such selected axis during operation by impressing alternating forces by said reciprocating body through said resilient drive element directly on said ram means and equally and oppositely on said frame,
output means comprising tool guide means on said frame, and impact tool means operatively mounted in said tool guide means for reciprocation substantially along such selected axis, said impact tool means located for receiving successive impacts from said ram means during reciprocation of the latter,
said output means further comprises spaced stop means including frame stop means on said frame and tool stop means on said impact tool means for limiting maximum relative travel between said frame and said impact tool means,
wherein the improvement comprises:
said frame stop means and said tool stop means being spaced respectively along such selected axis sufficiently beyond the maximum limits of the dynamic excursions of said frame along such selected axis relative to said impact tool means for free dynamic excursions of the frame clear of restrictive contact between the frame stop means and the tool stop means during operation of the impact device,
resilient bias means operatively interposed between said frame and said impact tool means for constantly transmitting tool bias force from said frame to said impact tool means in a direction to urge said impact tool means firmly and continuously toward such workpiece during operation of said impact device and for suspending said frame and said frame stop means resiliently in a direction away from the workpiece clear of restrictive contact with said tool stop means, for free dynamic excursions of said frame relative to said impact tool means, such free dynamic excursions including the reactive reciprocative excursions of said frame resulting from such generation of reciprocation of said ram means reduced by the substantially opposite reciprocations of said reciprocating body relative to said frame, and including dynamic response to the frame as resiliently suspended on said resilient bias means, by variations in bias force applied to said frame and variations in workpiece occuring during operation of the impact device,
said resilient bias means comprising resilient means having sufficient spring stiffness and sufficient spring length to maintain said impact tool means substantially in constant contact with the workpiece and sufficient to suspend said frame resiliently within the medial portion of the maximum travel of the frame relative to the impact tool means between the frame stop means and the tool stop means for such free dynamic excursions of said frame clear of such restrictive contact between said frame stop means and said tool stop means during operation of said impact device under such bias force, said resilient means further having sufficient spring resilience and sufficient such spring length for such free dynamic excursions of said frame during operation of the impact device.

14. An impact device as claimed in claim 13 wherein said resilient bias means comprises:
bias support means on the frame,
bias support means on the impact tool means, and
said resilient means interposed between said bias support means on the frame and the bias support means on the impact tool means.

15. An impact device as claimed in claim 14 wherein:

said resilient means comprises at least one compression-type coil spring.

16. An impact device as claimed in claim 14 wherein: said resilient means comprises at least an air spring spring.

17. An impact device as claimed in claim 7 wherein: said impact tool means further comprises anvil means and an impact tool, said anvil means interposed between the ram means and the impact tool and free for reciprocation substantially along such selected axis, said anvil means being positioned to receive impacts from said ram means and to transmit the resulting impulsive force to said impact tool said resilient bias means being operatively interposed between said frame and said anvil to transmit continuous biasing force from said frame to said anvil, and thence to said tool.

18. An impact device as claimed in claim 17 wherein said resilient bias means comprises:

bias support means on said anvil means, matching bias support means on said frame, and resilient means interposed between said bias support means on said anvil means and the matching support means on said frame.

19. An impact device as claimed in claim 18 wherein: said resilient means comprises at least one coil spring.

20. An impact device as claimed in claim 18 wherein: said anvil means portion having an has a main external cylindrical shape with another cylindrical portion of larger diameter forming a collar thereon, and said bias support means on said anvil means comprises the collar on said anvil means.

21. An impact device as claimed in claim 20 wherein: said anvil means comprises a main barrel portion with one end enclosed, said collar is secured on said anvil near the enclosed end thereof, and said main barrel portion fits over the end of said impact tool farther from the workpiece.

22. An impact device for operation with bias force applied toward a workpiece and comprising a frame including elements secured thereon having substantial relative weight, a power driven ram driven to reciprocate through successive cycles along an axis extending lengthwise of the frame, output tool means slidably mounted for reciprocation relative to the frame substantially along said axis and for receiving an impact from the ram at the completion of each reciprocative cycle thereof and for transmitting such impact through tool means to the workpiece, and tool stop means on the tool means and frame stop means on the frame for limiting maximum travel of the frame relative to the tool means during operation of the impact device, wherein the improvement comprises:

stabilizing means for substantially eliminating reciprocative impacting between said frame stop means, for stabilizing reciprocative motion of said frame, and for increasing the impact device effectiveness and efficiency with improved hammer-chisel type impacting during operation of the device; said stabilizing means comprising:

spacing the tool stop means relative to the frame stop means for sufficient said maximum travel of the frame relative to the impact tool means to provide for substantially free reciprocative lengthwise excursions of the frame relative to the tool means substantially clear of impacting contact between the tool stop means and the frame stop means during said operation of the impact device, and interposing between the frame and the tool means resilient bias means of sufficient spring stiffnes and sufficient length to support the frame within the medial portion of said maximum travel of the frame relative to the tool means and substantially clear of impacting contact between the tool stop means and the frame stop means during such operation of the impact device, and sufficient to maintain the tool means substantially in constant contact with the workpiece during such operation of the impact device.

23. An impact device as claimed in claim 22 wherein: said resilient bias means comprises at least one coil spring.

24. An impact device as claimed in claim 22 wherein: said resilient bias means comprises an air spring.

25. An impact device as claimed in claim 22 wherein said resilient means comprises an air spring.

26. An impact device as claimed in claim 22, wherein said resilient means comprises at least one coil spring.

27. An impact device as claimed in claim 22 wherein said resilient bias means comprises at least one coil spring.

28. An impact device as claimed in claim 22 wherein said power driven ram is driven by pneumatic means.

29. An impact device as claimed in claim 22 wherein said power driven ram is driven by a reciprocating cylinder-piston air spring reciprocated by a rotating crankshaft through at least one connecting rod, the piston having a shaft secured thereon, and said ram comprises said piston and said shaft.

30. An impact device for generating and transmitting successive impacts to a workpiece comprising:

a frame, ram means mounted for reciprocation along a substantially straight selected path relative to said frame, power drive means acting between the ram means and the frame to generate reciprocating motion of said ram means along the selected path by reaction against the frame, a tool holder comprising a barrel mounted in said frame for reciprocation substantially along said selected path, said barrel having a first cylindrical outer portion toward the end thereof farthest from said workpiece fitted for sliding in a first hollow cylinder in the frame and a second cylindrical outer portion of larger cross-sectional area toward the opposite end of said barrel fitted for slidable sealable reciprocation in a second hollow cylinder in said frame for substantially preventing dust leaking past said cylindrical outer portion of larger cross-sectional area during operation of the device, a first lateral structural portion secured to said first hollow cylinder and a second lateral structural portion secured to said second cylindrical outer portion, spring means positioned in the second hollow cylinder between said first and said second lateral structural portions, an impact tool having a cylindrical shank end fitted for insertion and mounting substantially coaxially in said cylindrical barrel, and to extend therethrough to receive impacting from said ram means, stop means on said impact tool and on said frame including tool stop means on said impact tool to limit the movement of said shank into said barrel, and releasable stop means on said frame to limit motion of said barrel in a direction toward said workpiece, and sufficient spacing between said releasable stop means and said first lateral structural portion, and sufficient spring length of said spring means for maximum travel of the frame relative to the impact tool to provide for free reciprocative lengthwise excursions of the frame relative to the impact tool means clear of contact between said stop means on said tool means and on said frame during operation of the impact device, and sufficient spring stiffness of said spring means to support the frame within the medical portion of said maximum travel clear of substantial contact between said stop means during operation of the impact device and to maintain the impact tool means in substantially constant contact with the workpiece during such operation of the impact device.

31. An impact device comprising:

a frame, ram means operatively mounted for reciprocation along a selected axis on said frame, power drive means operatively connected between said frame and said ram means to reciprocate said ram means into impacting reciprocating motion by successive reactions in opposite directions between the frame and the ram, a tool, guide means on said frame for guiding said tool for reciprocation substantially along such selected axis, anvil means interposed between said ram means and said tool to receive successive impacts from said ram on reciprocation of the latter, and to transmit force from such impacts to said tool, resilient bias means interposed between said frame and said anvil means to exert a continuous bias force rom said frame to said anvil means and acting to hold said anvil means firmly against said tool, and said tool firmly against a workpiece during operation of the device, and to support said frame in unobstructed reactive motion relative to said tool and said anvil means, said resilient bias means comprises an air spring further comprising, a cylindrical cavity formed in said frame, said anvil means comprises a collar portion slidably and sealably fitted for reciprocation in said cylindrical cavity, and an anvil-sealing barrel extending from said anvil means in a direction away from said tool, said power drive means comprising at least a cylinder mounted for reciprocation on such selected axis along said frame, and a piston with shaft thereon fitted for axial reciprocation in said cylinder, said ram means comprising said piston and said shaft, said cylinder being enclosed by at least one end element secured thereon, said end element having a cylinder end barrel externally therefrom, said anvil-sealing barrel fitted and located to slide in said cylinder end barrel, said cylindrical cavity and said anvil means forming a bias air chamber, seal means to provide for flow out of said anvil-sealing barrel and into said cylindrical cavity and to prevent reverse flow, the reciprocating motion of said ram means acting to pump air through said seal means, flow duct means having a check valve therein interconnected to permit flow out of said cylindrical cavity, and flow duct means having a directional flow valve therein to permit flow into the interior of the cylinder end barrel.

32. An impact device for generating and transmitting successive impacts to a workpiece comprising:

a frame, ram means mounted for reciprocation along a selected axis relative to said frame, power drive means comprising a cylindrical fluid chamber in said frame and a piston slidably and sealably fitted therein, and fluid drive means and valve operative to alternately admit pressurized fluid into and exhaust fluid from said chamber to reciprocate said piston therein, said piston comprises said ram means, output means comprising at least a tool operatively mounted on said frame for reciprocation substantially along such selected axis and anvil means interposed between the ram means and the tool and free for reciprocating substantially along such selected axis, said anvil means being positioned to receive impacts from said ram and to transmit the resulting impact force to said tool, said resilient bias means being operatively interposed between said frame and said anvil to transmit continuous biasing force from said frame to said anvil, and thence to said tool in a direction to urge said tool firmly toward such workpiece and to maintain said frame and attachments thereto clear of restrictive contact with said tool along such selected axis, during operation of the impact device, said resilient bias means comprises an air spring, such fluid is air, said anvil means comprises a first cylindrical portion having a larger cross-sectional area than a second cylindrical portion, said first cylindrical portion slidably and sealably fitted in a cylindrical cavity in said frame between said cylindrical fluid chamber and said tool, said second cylindrical portion slidably and sealably fitted in an enclosing wall between said cylindrical fluid chamber and said cylindrical cavity, said anvil means, said cylindrical cavity, and said enclosing wall forming an enclosed chamber of variable volume, and at least one duct opening in said enclosing wall and unidirectional flow means for passage of air into said enclosed chamber through said enclosing wall, the opposite side of said enclosing wall being under pressure from said fluid drive means.

* * * * *